US006346190B1

(12) United States Patent
Khare

(10) Patent No.: US 6,346,190 B1
(45) Date of Patent: Feb. 12, 2002

(54) DESULFURIZATION AND NOVEL SORBENTS FOR SAME

(75) Inventor: Gyanesh P. Khare, Bartlesville, OK (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/532,160

(22) Filed: Mar. 21, 2000

(51) Int. Cl.[7] ..... C10G 29/08; B01J 20/02

(52) U.S. Cl. ..... 208/244; 208/247; 502/406; 502/517; 502/325; 502/328; 502/329

(58) Field of Search ..... 502/406, 517, 502/325, 328, 329; 208/244, 247

(56) References Cited

U.S. PATENT DOCUMENTS 3,953,370 A * 4/1976 Miklas ..... 502/329
4,732,888 A 3/1988 Jha et al. ..... 502/406
5,244,641 A 9/1993 Khare ..... 423/220
5,306,685 A 4/1994 Khare ..... 502/253
5,520,797 A 5/1996 Ino et al. ..... 208/113
5,618,611 A 4/1997 Jin et al. ..... 428/209
5,753,198 A 5/1998 Ayala et al. ..... 423/210
5,914,288 A 6/1999 Turk et al. ..... 502/38

* cited by examiner

*Primary Examiner*—Elizabeth D. Wood
(74) *Attorney, Agent, or Firm*—Jack E. Phillips

(57) ABSTRACT

Particulate sorbent compositions consisting essentially of zinc ferrite, nickel and an inorganic binder, wherein the zinc ferrite and nickel of reduced valence, are provided for the desulfurization of a feedstream of cracked-gasoline or diesel fuels in a desulfurization zone by a process which comprises contacting of such feedstreams in a desulfurization zone followed by separation of the resulting low sulfur-containing stream and sulfurized sorbent and thereafter regenerating and activating the separated sorbent by reduction thereof before recycle of same to the desulfurization zone.

22 Claims, No Drawings

DESULFURIZATION AND NOVEL SORBENTS FOR SAME

FIELD OF THE INVENTION

This invention relates to the removal of sulfur from fluid streams of cracked-gasolines and diesel fuels. In another aspect this invention relates to sorbent compositions suitable for use in the desulfurization of fluid streams of cracked-gasolines and diesel fuel. A further aspect of this invention relates to a process for the production of sulfur sorbents for use in the removal of sulfur bodies from fluid streams of cracked gasolines and diesel fuels.

BACKGROUND OF THE INVENTION

The need for cleaner burning fuels has resulted in a continuing world wide effort to reduce sulfur levels in gasoline and diesel fuels. The reducing of gasoline and diesel sulfur is considered to be a means for improving air quality because of the negative impact the fuel sulfur has on the performance of automotive catalytic converters. The presence of oxides of sulfur in automotive engine exhaust inhibits and may irreversibly poison noble metal catalysts in the converter. Emissions from an inefficient or poisoned converter contain levels of non-combusted, non-methane hydrocarbon and oxides of nitrogen and carbon monoxide. Such emissions are catalyzed by sunlight to form ground level ozone, more commonly referred to as smog.

Most of the sulfur in gasoline comes from the thermally processed gasolines. Thermally processed gasolines such, as for example, thermally cracked gasoline, visbreaker gasoline, coker gasoline and catalytically cracked gasoline (hereinafter collectively called "cracked-gasoline") contains in part olefins, aromatics, and sulfur-containing compounds.

Since most gasolines, such as for example automobile gasolines, racing gasolines, aviation gasoline and boat gasolines contain a blend of at least in part cracked-gasoline, reduction of sulfur in cracked-gasoline will inherently serve to reduce the sulfur levels in such gasolines.

The public discussion about gasoline sulfur has not centered on whether or not sulfur levels should be reduced. A consensus has emerged that lower sulfur gasoline reduces automotive emissions and improves air quality. Thus the real debate has focused on the required level of reduction, the geographical areas in need of lower sulfur gasoline and the time frame for implementation.

As the concern over the impact of automotive air pollution continues, it is clear that further efforts to reduce the sulfur levels in automotive fuels will be required. While the current gasoline products contain about 330 parts per million (ppm) sulfur, the U.S. Environmental Protection Agency recently issued regulations requiring the average sulfur content in gasoline to be less than 30 ppm average with an 80 ppm cap. By 2006 the standards will effectively require every blend of gasoline sold in the United States to meet the 30 ppm level.

In view of the ever increasing need to be able to produce a low sulfur content automotive fuel, a variety of processes have been proposed for achieving industry compliance with the Federal mandates.

One such process which has been proposed for the removal of sulfur from gasoline is called hydrodesulfurization. While hydrodesulfurization of gasoline can remove sulfur-containing compounds, it can result in the saturation of most if not all, of the olefins contained in the gasoline. This saturation of olefins greatly affects the octane number (both the research and motor octane number) by lowering it. These olefins are saturated due to, in part, the hydrodesulfurization conditions required to remove thiophenic compounds (such as, for example, thiophene, benzothiophene, alkyl thiophenes, alkylbenzothiphenes and alkyl dibenzothiophenes), which are some of the most difficult sulfur-containing compounds to removed. Additionally, the hydrodesulfurization conditions required to remove thiophenic compounds can also saturate aromatics.

In addition to the need for removal of sulfur from cracked-gasolines, there is also presented to the petroleum industry a need to reduce the sulfur content of diesel fuels. In removing sulfur from diesel by hydrodesulfurization, the cetane is improved but there is a large cost in hydrogen consumption. This hydrogen is consumed by both hydrodesulfurization and aromatic hydrogenation reactions.

Thus there is a need for a process wherein desulfurization without hydrogenation of aromatics is achieved so as to provide a more economical process for the treatment of diesel fuels.

As a result of the lack of success in providing successful and economically feasible process for the reduction of sulfur levels in both cracked-gasolines and diesel fuels, it is apparent that there is still needed a better process for the desulfurization of both cracked-gasolines and diesel fuels which has minimal effect on octane while achieving high levels of sulfur removal.

It is thus an object of the present invention to provide a novel sorbent system for the removal of sulfur from fluid streams of cracked-gasolines and diesel fuels.

Another object of this invention is to provide a process for the production of novel sorbents which are useful in the desulfurization of such fluid streams.

Another object of this invention is to provide a process for the removal of sulfur-containing compounds from cracked-gasolines and diesel fuels which minimize saturation of olefins and aromatics therein.

A still further object of this invention is to provide a desulfurized cracked-gasoline that contains less than about 100 parts per million of sulfur based on the weight of the desulfurized cracked-gasoline and which contains essentially the same amount of olefins and aromatics as were in the cracked-gasoline from which it is made.

Other aspects, objects and the several advantages of this invention will be apparent from the following description of the invention and the appended claims.

SUMMARY OF THE INVENTION

In my application Ser. No. filed 09/531/815 filed Mar. 21, 2001 it was discovered that through the use of a reduced zinc ferrite sorbent in a sorbent composition consisting essentially of reduced zinc ferrite and an inorganic binder there is achieved a novel sorbent composition which permits the ready removal of sulfur from streams of cracked-gasoline or diesel fuels with a minimal effect on the octane rating of the treated streams.

The present invention provides an improved zinc ferrite sorbent system which is based upon my discovery that through the addition of a nickel promotor to the zinc ferrite sorbent system that on reduction of the resulting zinc ferrite nickel composition there is achieved a novel sorbent system with enhanced activity for the desulfurization of cracked-gasolines or diesel fuels which is demonstrated through the obtaining of a sorbent composition which on recycle achieves levels of desulfurization as that achieved by the fresh sorbent system.

Accordingly, in one aspect of the present invention there is provided a novel sorbent suitable for the desulfurization of cracked-gasolines or diesel fuels which consists essentially of a nickel impregnated reduced zinc ferrite in association with an inorganic binder wherein the zinc ferrite and nickel have a reduced valence and wherein the reduced zinc ferrite nickel is present in an amount to permit the removal of sulfur from cracked-gasolines or diesel fuels.

In accordance with another aspect of the present invention, there is provided a process for the preparation of a novel sorbent composition which comprises admixing zinc oxide, iron oxide, inorganic binder, acid and water and optionally a pore forming agent, so as to form a wet mix, dough, paste or slurry thereof, particulating the wet mix, dough, paste or slurry thereof so as to form a particulate granule, extrudate, tablet, sphere, pellet or microsphere thereof, drying the resulting particulate, calcining the dried particulate under conditions to form zinc ferrite, impregnating the resulting zinc ferrite composition with nickel, drying the impregnated composition, calcining the resulting dried particulate and thereafter reducing the resulting calcined zinc ferrite nickel containing product with a suitable reducing agent, such as hydrogen, so as to produce a sorbent composition having a reduced valence zinc ferrite and nickel content in an amount which is sufficient to permit removal with same of sulfur from a cracked-gasoline or diesel fuel stream.

In accordance with a further aspect of the present invention there is provided a process for the desulfurization of a cracked-gasoline or diesel fuel stream which comprises desulfurizing in a desulfurization zone a cracked-gasoline or diesel fuel with a solid reduced zinc ferrite nickel sorbent, separating the desulfurized cracked-gasoline or diesel fuel from the sulfurized sorbent, regenerating at least a portion of the sulfurized solid zinc ferrite nickel sorbent to produce a regenerated desulfurized zinc ferrite nickel sorbent, activating at least a portion of the regenerated desulfurized sorbent to produce a reduced zinc ferrite nickel sorbent and thereafter, returning at least a portion of the resulting reduced valence zinc ferrite nickel containing sorbent to the desulfurization zone.

DETAILED DESCRIPTION OF THE INVENTION

The term "gasoline" as employed herein is intended to mean a mixture of hydrocarbons boiling from about 100° F. to approximately 400° F. or any fraction thereof. Such hydrocarbons will include, for example, hydrocarbon streams in refineries such as naphtha, straight-n naphtha, coker naphtha, catalytic gasoline, visbreaker naphtha, alkylate, isomerate or reformate.

The term "cracked-gasoline" as employed herein is intended to mean hydrocarbons boiling from about 100° F. to approximately 400° F. or any fraction thereof that are products from either thermal or catalytic processes that crack larger hydrocarbon molecules into smaller molecules. Examples of thermal processes include coking, thermal cracking and visbreaking. Fluid catalytic cracking and heavy oil cracking are examples of catalytic cracking. In some instances the cracked-gasoline may be fractionated and/or hydrotreated prior to desulfurization when used as a feed in the practice of this invention.

The term "diesel fuel" as employed herein is intended to mean a fluid composed of a mixture of hydrocarbons boiling from about 300° F. to approximately 750° F. or any fraction thereof. Such hydrocarbon streams include light cycle oil, kerosene, jet fuel, straight-run diesel and hydrotreated diesel.

The term "sulfur" as employed herein is intended to mean those organosulfur compounds such as mercaptans or those thiophenic compounds normally present in cracked gasolines which include among others thiophene, benzothiophene, alkyl thiophenes, alkyl benzothiophenes and alkyldibenzothiophenes as well as the heavier molecular weights of same which are normally present in a diesel fuel of the types contemplated for processing in accordance with the present invention.

The term "gaseous" as employed herein is intended to mean that state in which the feed cracked-gasoline or diesel fuel is primarily in a vapor phase.

The term "nickel" as used herein is intended to mean the metal nickel, nickel oxide or a precursor for nickel.

The term "reduced zinc ferrite nickel" as used herein is intended to mean that zinc ferrite compound produced through the calcination of zinc oxide and iron oxide and impregnated with nickel which has been subjected to reduction with an appropriate reducing agent, preferably hydrogen, so that the valence of the metals of the zinc ferrite and nickel compounds have been reduced to a state below that at which they are normally present.

While it is presently preferred that the nickel promotor be added to the zinc ferrite by impregnation, it is also possible to incorporate the promotor metal into the zinc oxide-iron mix thus forming a zinc ferrite-nickel composition on calcination of the mix.

The present invention provides an improved zinc ferrite sorbent system which is based upon my discovery that through the addition of a nickel promotor to the zinc ferrite sorbent system consisting essentially of zinc ferrite, nickel and an inorganic binder such as alumina that on reduction of the resulting zinc ferrite nickel composition there is achieved a novel sorbent system with enhanced activity for the removal of thiophenic sulfur compounds from fluid streams of cracked-gasolines or diesel fuels without having a significant adverse effect on the olefin content of such streams, thus avoiding a significant reduction of octane values of the treated stream which is demonstrated through the obtaining of a sorbent composition which on recycle achieves the desired low levels of sulfur as that achieved by a fresh zinc ferrite sorbent system. Through the achieving of such enhanced performance of the sorbent system there is achieved an extended life of use of the sorbent system prior to the necessity of having to regenerate.

In a presently preferred embodiment of this invention, the sorbent composition has a zinc ferrite content in the range of from about 5 to about 90 weight percent.

The zinc oxide used in the preparation of the sorbent composition can either be in the form of zinc oxide, or in the form of one or more zinc compounds that are convertible to zinc oxide under the conditions of preparation described herein. Examples of such zinc compounds include, but are not limited to, zinc sulfide, zinc sulfate, zinc hydroxide, zinc carbonate, zinc acetate and zinc nitrate. Preferably, the zinc oxide is in the form of powdered zinc oxide.

The iron oxide used in the preparation of the sorbent composition can either be in the form of iron oxide, or in the form of one or more iron compounds that are convertible to iron oxide under the conditions of preparation described herein. Examples of such iron compounds include, but are not limited to, iron sulfide, iron sulfate, iron hydroxide, iron carbonate, iron acetate and iron nitrate. Preferably, the iron oxide is in the form of powdered iron oxide.

In addition to the formation of a mixture of zinc oxide and iron oxide, the novel sorbent system of this invention has present an inorganic binder which serves to bind the resulting zinc ferrite particles into a cohesive system.

The binder component can be any suitable compound that has cement-like properties, or clay-like properties, which can help to bind the particulate composition together. Suitable examples of such binder components include, but are not limited to silica, alumina, cements such as for example, gypsum plaster, common lime, hydraulic lime, natural cements, Portland cements, and high alumina cements, and clays, such as for example, attapulgite, bentonite, halloysite, hectorite, kaolinite, montmorillonite, pyrophylite, sepiolite, talc and vermiculite. The amount of binder used is in the range of from about 0.1 to about 30 weight percent, based on the total weight of the components. However, an amount in the range of about 1 to about 20 weight percent is preferred.

In a presently preferred embodiment of this invention, the binder employed is alumina. Any suitable commercially available alumina or aluminosilicate materials including hydrated alumina, flame hydrolyed alumina, colloidal alumina solution and, generally, those alumina compounds produced by the dehydration of alumina hydrates are useful in preparing the sorbent system of this invention. One particularly preferred alumina is Catapal alumina available from Condea Vista Company, Houston, Texas.

In the formation of the sorbent system, it is also presently preferred that a pore forming material be added to the initial mixture of zinc oxide, iron oxide and binder. Such materials are normally burned off during the calcination of the particulate sorbent system so as to provide porosity to the resulting zinc ferrite system. Examples of such pore forming materials are cellulose, cellulose gel, microcrystalline cellulose, zinc stearate, ammonium carbonate, ammonium nitrate and graphite. In one presently preferred embodiment of the present invention there is utilized Lattice® NT-100, a microcrystalline cellulose available from FMC Corporation, Philadelphia, Pa.

The initial mix of zinc oxide, iron oxide and inorganic binder generally is formed from about 2 to about 70 weight percent zinc oxide and from about 3 to about 70 weight percent iron oxide.

In the formation of the desired zinc ferrite component of the sorbent system there is generally employed a zinc oxide and iron oxide in an amount such that the ratio of zinc to iron is in the range of about 0.5:2 to about 1.5:2. Presently a ratio of about 1:2 is preferred.

The binder such as alumina is utilized in amounts such that there is achieved a binder of zinc ferrite in the ultimate sorbent composition. Generally such binders are employed in an amount in the range of about 0.1 to about 30 weight percent based on the total weight of the sorbent composition.

The pore forming compounds are generally added to the initial mix of zinc oxide and iron oxide in an amount to achieve a desired porosity in the final calcined sorbent product. Generally an amount in the range of from about 0.1 to about 15 weight percent based on the total weight of the initial mix of zinc oxide, iron oxide and binder employed.

In the manufacture of the sorbent composition, the primary components of zinc oxide, iron oxide and binder, preferably alumina, are combined together in appropriate proportions by any suitable manner which provides for the intimate mixing of the components to provide a substantially homogeneous mixture.

Any suitable means for mixing the sorbent components can be used to achieve the desired dispersion of the materials. Such means include, among others, tumblers, stationary shells or troughs, Muller mixers, which are of the batch or continuous type, impact mixers and the like. It is presently preferred to use a Muller mixer in the mixing of the iron oxide, alumina and zinc oxide components.

Once the sorbent components are properly mixed to provide a shapeable mixture, the resulting mixture can be in the form of wet mix, dough, paste or slurry. If the resulting mix is in the form of a wet mix, the wet mix can be densified and thereafter particulated through the granulation of the densified mix following the drying and calcination of same. When the admixture of zinc oxide, iron oxide and alumina results in a form of the mixture which is either in a dough state or paste state, the mix can be shaped to form a particulate granule, extrudate, tablet, sphere, pellet or microsphere. Presently preferred are cylindrical exrudates having from 1/32 inch to ½ inch diameter and any suitable length. The resulting particulate is then dried and then calcined. When the mix is in the form of a slurry, the particulation of same is achieved by spray drying the slurry to form microspheres thereof having a size of from about 20 to about 500 microns. Such microspheres are then subjected to drying and calcination. Following the drying and calcination of the particulated mixture, there is achieved a zinc ferrite containing particulate.

Following calcination, the resulting particulate consisting essentially of zinc ferrite and binder is impregnated with nickel or a nickel compound in an amount sufficient to provide a nickel content in the impregnated particulate in an amount in the range of from about 1 to about 50 weight percent.

After nickel impregnation, the resulting composition is dried generally at a temperature in the range of about 100° F. to about 500° F. and thereafter calcined, generally at a temperature in the range of about 600° F. to about 2000° F.

Nickel compounds which arc suitable for the impregnation of the zinc ferrite binder composites are those selected from the group of nickel, nickel oxide or a precursor for nickel oxide.

Following calcination the resulting particulate consisting essentially of zinc ferrite, nickel and binder is subjected to reduction with a suitable reducing agent, preferably hydrogen, so as to produce a zinc ferrite nickel composition having a reduced valence content with such reduced metal content of the zinc ferrite and nickel being present in an amount to permit extended use of the sorbent for the removal with same of sulfur from a cracked-gasoline or diesel fuel fluid stream.

The solid reduced zinc ferrite nickel sorbent of this invention is a composition that has the ability to react with and/or chemisorb with organo-sulfur compounds, such as thiophenic compounds. It is also preferable that the sorbent removed diolefins and other gum forming compounds from the cracked-gasoline.

The solid reduced sorbent of this invention consists essentially of reduced zinc ferrite nickel and an inorganic binder. The amount of reduced zinc ferrite and nickel in the solid reduced sorbent system of this invention is that amount which will permit the removal of thiophenic sulfur compounds from a cracked-gasoline or diesel fuel stream when contacted with same under appropriate desulfurization conditions. Such amounts of zinc ferrite are generally in the range of about 5 to about 90 weight percent and the amounts of nickel are generally in the range of about 15 to about 30 weight percent of the total weight of the sorbent composition.

The sorbent composition may contain insignificant amounts of separate solid phases of individual metals of oxides of iron and zinc which have not been converted to the desired zinc ferrite form during the preparation of the zinc ferrite through the calcination of the iron oxide and zinc oxide mix. Such minor amounts of such metals which have not been chemically combined in the zinc ferrite are not expected to significantly affect the sorption capacity and performance of the sorbent compositions of this invention.

From the above, it can be appreciated that the sorbent compositions which are useful in the desulfurization process of this invention can be prepared by a process which comprises:

(a) admixing zinc oxide, iron oxide and inorganic binder so as to form a mix of same in the form of one of a wet mix, dough, paste or slurry;

(b) particulating the resulting mix to form particulates thereof in the form of one of granules, extrudates, tablets, pellets, spheres or microspheres;

(c) drying the resulting particulate;

(d) calcining the dried particulate;

(e) impregnating the resulting calcined particulate with nickel, nickel oxide or a precursor for nickel;

(f) drying the impregnated particulate;

(g) calcining the resulting dried particulate; and (h) reducing the calcined zinc ferrite-nickel particulate of (g) with a suitable reducing agent so as to produce a particulate composition having a substantial reduced valence iron and nickel content therein and wherein the reduced valence iron and nickel content is present in an amount sufficient to permit the removal with same of sulfur from a cracked-gasoline or diesel fuel fluid stream when contacted with the resulting reduced particulated sorbent.

The process to use the novel sorbents to desulfurize cracked-gasoline or diesel fuels to provide a desulfurized cracked-gasoline or diesel fuel comprises:

(a) desulfurizing in a desulfurization zone a cracked-gasoline or diesel fuel with a solid reduced zinc ferrite nickel containing sorbent;

(b) separating the desulfurized cracked-gasoline or desulfurized diesel fuel from the resulting sulfurized solid sorbent;

(c) regenerating at least a portion of the sulfurized solid sorbent to produce a regenerated desulfurized solid sorbent;

(d) reducing at least a portion of the regenerated desulfurized solid sorbent to produce a solid reduced zinc ferrite nickel containing sorbent thereafter and;

(e) returning at least a portion of the regenerated solid reduced zinc ferrite nickel containing sorbent to the desulfurization zone.

The desulfurization step (a) of the present invention is carried out under a set of conditions that includes total pressure, temperature, weight hourly space velocity and hydrogen flow. These conditions are such that the solid reduced zinc ferrite nickel containing sorbent can desulfurize the cracked-gasoline or diesel fuel to produce a desulfurized cracked-gasoline or desulfurized diesel fuel and a sulfurized sorbent.

In carrying out the desulfurization step of the process of the present invention, it is preferred that the feed cracked-gasoline or diesel fuel be in a vapor phase. However, in the practice of the invention it is not essential, albeit preferred, that the feed be totally in a vapor or gaseous state.

The total pressure can be in the range of about 15 psia to about 1500 psia. However, it is presently preferred that the total pressure be in a range of from about 50 psia to about 500 psia.

In general, the temperature should be sufficient to keep the cracked-gasoline or diesel fuel essentially in a vapor phase. While such temperatures can be in the range of from about 100° F. to about 1000° F., it is presently preferred that the temperature be in the range of from about 400° F. to about 800° F. when treating as cracked-gasoline and in the range of from about 500° F. to about 900° F. when the feed is a diesel fuel.

Weight hourly space velocity (WHSV) is defined as the pounds of hydrocarbon feed per pound of sorbent in the desulfurization zone per hour. In the practice of the present invention, such WHSV should be in the range of from about 0.5 to about 50, preferably about 1 to about 20 $hr^{-1}$ In carrying out the desulfurization step, it is presently preferred that an agent be employed which interferes with any possible chemisorbing or reacting of the olefinic and aromatic compounds in the fluids which are being treated with the solid zinc ferrite nickel sorbent. Such an agent is presently preferred to be hydrogen.

Hydrogen flow in the desulfurization zone is generally such that the mole ratio of hydrogen to hydrocarbon feed is the range of about 0.1 to about 10, and preferably in the range of about 0.2 to about 3.0.

The desulfurization zone can be any zone wherein desulfurization of the feed cracked-gasoline or diesel fuel can take place. Examples of suitable zones are fixed bed reactors, moving bed reactors, fluidized bed reactors and transport reactors. Presently, a fluidized bed reactor or a fixed bed reactor is preferred.

If desired, during the desulfurization of the vaporized fluids, diluents such as methane, carbon dioxide, flue gas, and nitrogen can be used. Thus it is not essential to the practice of the process of the present invention that a high purity hydrogen be employed in achieving the desired desulfurization of the cracked-gasoline or diesel fuel.

It is presently preferred when utilizing a fluidized system that a solid sorbent be used that has a particle size in the range of about 20 to about 1000 micrometers. Preferably, such sorbents should have a particle size of from about 40 to about 500 micrometers. When a fixed bed system is employed for the practice of the desulfurization process of this invention, the sorbent should be such as to have a particle size in the range of about 1/32 inch to about 1/2 inch diameter.

It is further presently preferred to use solid zinc ferrite nickel containing sorbents that have a surface area of from about 1 square meter per gram to about 1000 square meters per gram of solid sorbent.

The separation of the gaseous or vaporized desulfurized fluids and sulfurized sorbent can be accomplished by any means known in the art that can separate a solid from a gas. Examples of such means are cyclonic devices, settling chambers or other impingement devices for separating solids and gases. The desulfurized gaseous cracked-gasoline or desulfurized diesel fuel can then be recovered and preferably liquefied.

The gaseous cracked-gasoline or gaseous diesel fuel is a composition that contains in part, olefins, aromatics and sulfur-containing compounds as well as paraffins and naphthenes.

The amount of olefins in gaseous cracked-gasoline is generally in the range of from about 10 to 35 weight percent based on the weight of the gaseous cracked-gasoline. For diesel fuel there is essentially no olefin content.

The amount of aromatics in gaseous cracked-gasoline is generally in the range of about 20 to about 40 weight percent based on the weight of the gaseous cracked gasoline. The amount of aromatics in gaseous diesel fuel is generally in the range of about 10 to about 90 weight percent.

The amount of sulfur in cracked-gasolines or diesel fuels can range from about 100 parts per million sulfur by weight of the gaseous cracked-gasoline to about 10,000 parts per million sulfur by weight of the gaseous cracked-gasoline and from about 100 parts per million to about 50,000 parts per million for diesel fuel prior to the treatment of such fluids with the sorbent system of the present invention.

The amount of sulfur in cracked-gasolines or in diesel fuels following treatment of same in accordance with the desulfurization process of this invention is less than 100 parts per million.

In carrying out the process of this invention, if desired, a stripper unit can be inserted before the regenerator for regeneration of the sulfurized sorbent which will serve to remove a portion, preferably all, of any hydrocarbons from the sulfurized sorbent or before the hydrogen reduction zone so as to remove oxygen and sulfur dioxide from the system prior to introduction of the regenerated sorbent into the sorbent activation zone. The stripping comprises a set of conditions that includes total pressure, temperature and stripping agent partial pressure.

Preferably the total pressure in a stripper, when employed, is in a range of from about 25 psia to about 500 psia.

The temperature for such strippers can be in the range of from about 100° F. to about 1000° F.

The stripping agent is a composition that helps to remove hydrocarbons from the sulfurized solid sorbent. Presently, the preferred stripping agent is nitrogen.

The sorbent regeneration zone employs a set of conditions such that at least a portion of the sulfurized sorbent is desulfurized.

The total pressure in the regeneration zone is generally in the range of from about 10 to about 1500 psia. Presently preferred is a total pressure in the range of from about 25 psia to about 500 psia.

The sulfur removing agent partial pressure is generally in the range of from about 1 percent to about 25 percent of the total pressure.

The sulfur removing agent is a composition that helps to generate gaseous sulfur oxygen-containing compounds such a sulfur dioxide, as well as to burn off any remaining hydrocarbon deposits that might be present. Currently, oxygen-containing gases such as air are the preferred sulfur removing agent.

The temperature in the regeneration zone is generally from about 100° F. to about 1500° F. with a temperature in the range of about 800° F. to about 1200° F. being presently preferred.

The regeneration zone can be any vessel wherein the desulfurizing or regeneration of the sulfurized sorbent can take place.

The desulfurized sorbent is then reduced in an activation zone with a reducing agent so that at least a portion of the zinc ferrite nickel content of the sorbent composition is reduced to produce a solid reduced sorbent having an amount of reduced metal therein to permit the removal of sulfur components from a stream of cracked-gasoline or diesel fuel.

In general, when practicing the process of this invention, the reduction of the desulfurized sorbent is carried out at a temperature in the range of about 100° F. to about 1500° F. and a pressure in the range of about 15 to 1500 psia. Such reduction is carried out for a time sufficient to achieve the desired level of iron and nickel reduction in the sorbent system. Such reduction can generally be achieved in a period of from about 0.01 to about 20 hours.

Following the activation of the regenerated particulate sorbent, at least a portion of the resulting activated (reduced) sorbent can be returned to the desulfurization unit.

When carrying out the process of the present invention in a fixed bed system, the steps of desulfurization, regeneration, stripping, and activation are accomplished in a single zone or vessel.

The desulfurized cracked-gasoline resulting from the practice of the present invention can be used in the formulation of gasoline blends to provide gasoline products suitable for commercial consumption.

The desulfurized diesel fuels resulting from the practice of the present invention can likewise be used for commercial consumption where a low sulfur-containing fuel is desired.

EXAMPLES

The following examples are intended to be illustrative of the present invention and to teach one of ordinary skill in the art to make and use the invention. These examples are not intended to limit the invention in any way.

Example I

A solid zinc ferrite sorbent was produced by dry mixing 70 grams of zinc oxide, 142.5 grams of iron oxide (Bayferrox 130M Pigment, Miles Inc., Pittsburgh, Pa.), 37.5 grams of inorganic binder (Catapal D-hydrated alumina) and 10 grams of crystalline micro cellulose porosity agent (Lattice®NT 100). Following mixing of the dry powders for 10 minutes a solution consisting of 6.25 crams acetic acid in 100 grams of distilled water were added to the mixture. Following mixing in a Sigma mixer, the resulting paste was then extruded by means of a Bonnot extruder employing ⅛ inch diameter copper die. The resulting extrude were dried at 95° C. in an oven for about 3 hours and then calcined at a temperature of 815° C. for a period of 1 hour. The porosity agent was completely oxidized to gaseous products ($CO_2$, $H_2O$) during the calcining step.

Example II

The particulate solid zinc ferrite sorbent as prepared in Example I was tested for its desulfurization ability as follows.

A 1-inch quartz reactor tube was loaded with 10 grams of the sorbent ground to −12 to 20 mesh of Example I. This solid zinc feltite sorbent was placed in the middle of the reactor and subjected to reduction with hydrogen flowing at a rate of 300 cc/min with a bed temperature of 685° F. for a period of 1 hour.

Following reduction of the sorbent, cracked-gasoline having about 345 parts per million sulfur by weight sulfur-containing compounds based on the total weight of the gaseous cracked-gasoline, and having about 95 weight percent thiophenic compounds based on the weight of sulfur containing compounds in the gaseous cracked-gasoline was pumped upwardly through the reactor. The rate of flow of cracked-gasoline was 13.4 mil/hr. A flow of 300 cc/min of hydrogen was maintained during the treatment of the cracked gasoline with reduced zinc ferrite sorbent.

This produced sulfurized sorbent and desulfurized gaseous cracked-gasoline. A series of samples were collected at one hour intervals for a 5 hour period and subjected to analysis for sulfur content. The following results were obtained.

| Sample No. | Bed Temp. ° F. | Sample Wt. (grams) | Sulfur PPM |
|---|---|---|---|
| 1 | 740 | 7.70 | 5 |
| 2 | 757 | 9.80 | <5 |
| 3 | 757 | 9.36 | <5 |
| 4 | 764 | 9.48 | 5 |
| 5 | 765 | 9.60 | 10 |

The above data indicates that a significant reduction in sulfur content was achieved when utilizing the reduced zinc ferrite sorbent system.

Example III

Recycle of the sorbent system of Example II was carried out by first regenerating the spent sorbent for 2.5 hrs with a stream of a mixture of air and nitrogen containing four volume percent oxygen (flow rate: 300 cc/min) and a bed temperature of 896° F. On termination of air to the reactor, the sorbent was purged with nitrogen and then hydrogen was introduced at a flow rate of 300 cc/min for a period of one hour at a bed temperature of 700° F.

Following reduction of the sorbent, cracked-gasoline was introduced into the reactor at a flow rate of 13.4 ml/hr with a hydrogen flow of 300 cc/min.

A series of samples were obtained at one hour intervals over a 4 hour period and analyzed for sulfur content.

The following results were obtained.

| Sample No. | Bed Temp. ° F. | Sample Wt. (grams) | Sulfur PPM |
|---|---|---|---|
| 1 | 733 | 9.83 | 60 |
| 2 | 744 | 9.29 | 45 |
| 3 | 747 | 8.49 | 105 |
| 4 | 746 | 9.99 | 95 |

The above data demonstrate that the zinc ferrite sorbents are regenerable and are still effective in removing sulfur from cracked-gasoline even after regeneration.

Example IV 50 grams of the calcined zinc ferrite binder composition as produced in Example I was impregnated with a solution of 24.8 grams of nickel nitrate $SNi(NO_3)_2.6\ H_2O$ and 1 ml of distilled water, dried at a temperature of 150° C. for 1 hour and then calcined at a temperature of 635° C. for 1 hour to give a calcined zinc ferrite nickel composition having a nominal nickel content of 10 percent.

The thus impregnated zinc ferrite nickel compound was then impregnated with a second solution of 12.2 grams of nickel nitrate $Ni(NO_3)_2.6\ H_2O$ and 1 ml of distilled water, dried for 1 hour at 150° C. and then calcined at a temperature of 650° C. for 1 hour to provide a zinc ferrite nickel sorbent composition having a nickel content of 15 weight percent.

Example V

The particulate solid zinc ferrite nickel sorbent as prepared in Example IV was tested for its desulfurization ability as follows.

A 1-inch quartz reactor tube was loaded with 10 grams of the sorbent of Example IV. This solid zinc ferrite nickel binder sorbent was placed in the middle of the reactor and subjected to reduction with hydrogen flow at a rate of 300 cc/min in with a bed temperature of 685° F. for a period of 1 hour.

Following reduction of the sorbent, cracked-gasoline having about 345 parts per million sulfur by weight sulfur-containing compounds based on the total weight of the gaseous cracked gasoline and having about 95 weight percent thiophenic compounds based on the weight of sulfur containing compounds in the gaseous cracked gasoline was pumped upwardly through the reactor. The rate of flow of cracked-gasoline was 13.4 ml/hr. A flow of 300 cc/min of hydrogen was maintained during the treatment of the cracked gasoline with reduced zinc ferrite sorbent. This produced sulfurized sorbent and desulfurized gaseous cracked-gasoline. A series of samples were collected at one hour intervals for a 5 hour period and subjected to analysis for sulfur content. The following results were obtained.

| Sample No. | Bed Temp. ° F. | Sample Wt. (grams) | Sulfur PPM |
|---|---|---|---|
| 1 | 722 | 8.44 | 5 |
| 2 | 739 | 9.22 | <5 |
| 3 | 748 | 8.64 | <5 |
| 4 | 752 | 10.10 | 5 |
| 5 | 739 | 687 | 5 |

The above data indicates that a significant reduction in content is achieved when utilizing the reduced zinc ferrite nickel sorbent system.

Example VI

Recycle of the sorbent system of Example V was carried out by first regenerating the spent sorbent for 2.5 hours with a stream of a mixture of air and nitrogen containing four volume percent oxygen at a flow rate of 300 cc/min and a bed temperature of 896° F. On termination of air to the reactor the sorbent was purged with nitrogen and then hydrogen was introduced at a flow rate of 300 cc/min for a period of one hour at a bed temperature of 700° F.

Following reduction of the sorbent, cracked-gasoline was introduced into the reactor at a flow rate of 13.4 ml/hr with a hydrogen flow of 300 cc/min.

A series of samples were obtained at one hour intervals over a 4 hour period and analyzed for sulfur content.

The following results were obtained.

| Sample No. | Bed Temp. ° F. | Sample Wt. (grams) | Sulfur PPM |
|---|---|---|---|
| 1 | 722 | 6.41 | 5 |
| 2 | 736 | 10.10 | <5 |
| 3 | 743 | 8.34 | 5 |
| 4 | 740 | 09.76 | <5 |

The above data demonstrate that the sorbents of this invention not only give excellent removal of sulfur but are regenerable and continue to provide effective removal of sulfur from cracked gasoline after regeneration.

The specific examples herein disclosed are to be considered as being primarily illustrative. Various changes beyond those described will no doubt occur to those skilled in the art; and such changes are to be understood as forming a part of this invention insofar as they fall within the spirit and scope of the appended claims.

That which is claimed is:

1. A sorbent composition suitable for removal of sulfur from cracked gasolines and diesel fuels which consists essentially of (a) zinc ferrite, (b) nickel, and (c) an inorganic binder wherein said zinc ferrite and nickel are present in a reduced valence state and in an amount which effects the removal of sulfur from a stream of cracked-gasoline or diesel when contacted with said sorbent composition under desulfurization conditions.

2. A sorbent composition in accordance with claim 1 wherein said zinc ferrite is present in an amount in the range of from about 5 to about 90 weight percent and said nickel is present in an amount in the range of about 1 to about 50 weight percent.

3. A sorbent composition in accordance with claim 1 wherein said sorbent composition is a particulate in the form of one of granule, extrudate, tablet, sphere or microsphere.

4. A sorbent composition in accordance with claim 1 wherein said inorganic binder is selected from the group consisting of alumina, silica, cements, high alumina cements and clays.

5. A sorbent composition in accordance with claim 1 wherein said inorganic binder is selected from the group consisting of alumina and silica.

6. A sorbent composition in accordance with claim 1 wherein said inorganic binder is alumina.

7. A process for the production of a sorbent composition suitable for the removal of sulfur from a cracked-gasoline or diesel fuel stream which comprises:

(a) admixing zinc oxide, iron oxide and an inorganic binder so as to form a mix thereof;

(b) particulating the resulting mix so as to form particulates thereof;

(c) drying the particulate of step (b);

(d) calcining the dried particulate of step (c);

(e) impregnating the resulting calcined particulate of step (d) with nickel nickel oxide or a precursor for nickel oxide;

(f) drying the impregnated particulate of step (e);

(g) calcining the dried particulate of step (f); and thereafter (h) reducing the resulting particulate of step (g) with a suitable reducing agent under suitable conditions to produce a particulate composition having a reduced zinc ferrite nickel content therein such that the reduced zinc ferrite nickel containing compositions will affect the removal of sulfur from a stream of cracked-gasoline or diesel fuel when said stream is contacted with same under desulfurization conditions.

8. A process in accordance with claim 7 wherein there is additionally present in the mix (a) a pore forming agent.

9. A process in accordance with claim 7 wherein said mix is in the form of one of a wet mix, dough, paste or slurry.

10. A process in accordance with claim 7 wherein said particulate is in the form of one of granules, extrudates, tablets, spheres, pellets or microspheres.

11. A process in accordance with claim 7 wherein said zinc oxide is present in an amount in the range of about 2 to about 70 weight percent and said iron oxide is present in an amount in the range of from about 3 to about 70 weight percent.

12. A process in accordance with claim 7 wherein the particulate of step (b) and step (e) is dried at a temperature in the range of from about 100° F. to about 500° F.

13. A process in accordance with claim 7 wherein the dried particulate of step (c) and step (f) is calcined at a temperature in the range of about 600° F. to about 2000° F.

14. A process in accordance with claim 7 wherein said calcined particulate of step (g) is reduced in a reducing zone with a reducing agent under suitable conditions to effect a reduction of the resulting zinc ferrite and nickel therein so as to provide an amount of reduced zinc ferrite and nickel such that the resulting sorbent composition will effect the removal of sulfur from a cracked-gasoline or diesel fuel when treated with same under desulfurization conditions.

15. A process in accordance with claim 7 wherein said reduced zinc ferrite is present in an amount in the range of from about 5 to about 90 weight percent and said reduced nickel is present in an amount in the range of from about 1 to about 50 weight percent, based on the total weight of the sorbent composition.

16. A process in accordance with claim 7 wherein the reduction of the zinc ferrite nickel is carried out at a temperature in the range of about 100° F. to about 1500° F. and at a pressure in the range of about 15 psia to about 1500 psia for a time sufficient to permit the formation of the desired reduced zinc ferrite nickel component of the sorbent composition.

17. The sorbent product of the process of claim 7.

18. A process for the removal of sulfur from a stream of a cracked-gasoline or a diesel fuel which comprises:

(a) contacting said stream with a sorbent composition consisting essentially of zinc ferrite, nickel and an inorganic binder, wherein said zinc ferrite and nickel are present in a reduced state and in an amount which will effect the removal of sulfur from said stream in a desulfurization zone under conditions such that there is formed a desulfurized fluid stream of cracked-gasoline or diesel fuel and a sulfurized sorbent;

(b) separating the resulting desulfurized fluid stream from said sulfurized sorbent;

(c) regenerating at least a portion of the separated sulfurized sorbent in a regeneration zone so as to remove at least a portion of the sulfur absorbed thereon;

(d) reducing the resulting desulfurized sorbent in an activation zone so as to provide a reduced zinc ferrite content therein which will affect the removal of sulfur from a stream of a cracked-gasoline or diesel fuel when contacted with same; and thereafter (e) returning at least a portion of the resulting desulfurized, reduced sorbent to said desulfurization zone.

19. A process in accordance with claim 15 wherein said desulfurization is carried out at a temperature in the range of from about 100° F. to about 1000° F. and a pressure in the range of from about 15 to about 1500 psia for a time sufficient to affect the removal of sulfur from said stream.

20. A process in accordance with claim 18 wherein said regeneration is carried out at a temperature in the range of about 100° F. to about 1500° F. and a pressure in the range of about 10 to about 1500 psia for a time sufficient to effect the removal of at least a portion of sulfur from the sulfurized sorbent.

21. A process in accordance with claim 17 wherein there is employed air as a regeneration agent in said regeneration zone.

22. A process in accordance with claim 14 wherein said regenerated sorbent is subject to reduction with hydrogen in a hydrogenation zone which is maintained at a temperature in the range of about 100° F. to about 1500° F. and at a pressure in the range of about 15 to about 1500 psia and for a period of time sufficient to affect the reduction of the valence of the zinc ferrite content of said sorbent.

* * * * *